US005253589A

United States Patent [19]

Kawanishi et al.

[11] Patent Number: 5,253,589

[45] Date of Patent: Oct. 19, 1993

[54] FOLDING DOOR APPARATUS FOR A RAILWAY PLATFORM

[75] Inventors: Isamu Kawanishi; Yukio Uozumi, both of Kobe, Japan

[73] Assignee: Kawasaki Jukogyo Kabushiki Kaisha, Japan

[21] Appl. No.: 917,945

[22] Filed: Jul. 24, 1992

[30] Foreign Application Priority Data

Jul. 31, 1991 [JP] Japan ..... 3-060406[U]
Jul. 31, 1991 [JP] Japan ..... 3-191751

[51] Int. Cl.[5] ..... B61B 1/02
[52] U.S. Cl. ..... 104/28; 105/341
[58] Field of Search ..... 104/27, 28, 30; 105/339, 332, 341, 343; 49/128, 130, 118, 209, 210; 160/186, 187, 188, 199, 206

[56] References Cited

U.S. PATENT DOCUMENTS 1,051,054 1/1913 Anderson ..... 105/341
1,266,980 5/1918 Norton ..... 160/186
4,981,164 1/1991 Reichel ..... 160/187

FOREIGN PATENT DOCUMENTS 2725549 1/1979 Fed. Rep. of Germany ..... 160/186
2412449 8/1979 France ..... 105/339
0018516 2/1979 Japan ..... 104/28
57-2537 1/1982 Japan .

*Primary Examiner*—Mark T. Le
*Attorney, Agent, or Firm*—Oliff & Berridge

[57] ABSTRACT

A folding door apparatus for a railway platform has a plurality of continuously provided folding doors each composed of two elements, a mid-portion between the two elements serving as an inflection point, the plurality of folding doors being movable between closed positions in which the folding doors are disposed in a line along a railway platform and inflected positions in which openings in the folding door apparatus are formed; a door opening and closing driving apparatus including a pair of opening and closing acting bodies for moving the folding doors in a direction and amount necessary to form the openings in the folding door apparatus; and a logic unit for analyzing information regarding the positions and widths of entrances of a railway vehicle stopped at the platform, and controlling the direction and amount of movement of the folding doors such that the openings in the folding door apparatus correspond to the entrances of the railway vehicle.

4 Claims, 13 Drawing Sheets

FOLDING DOOR APPARATUS FOR A RAILWAY PLATFORM

BACKGROUND OF THE INVENTION

1. Field of the Invention

This invention relates to an apparatus for opening and closing doors, and particularly to a door opening and closing apparatus for a railway platform which can accommodate trains having entrances of varying positions widths.

2. Description of the Prior Art

It is proposed by the official gazette of Japanese Patent Publication Application No. 57-2537 to form, at a platform for railway vehicles, a partition including a wall on the side of the platform facing the track and sliding doors on a face of the wall. The opening position of the sliding doors is adjusted in response to an error in the stopping position of a railway vehicle stopped at the platform, in order to assure the safety of passengers or enhance the air conditioning efficiency of a building formed at the platform. This type of structure functions well when the type of railway vehicle is fixed.

However, with the sliding door apparatus for a railway platform as described above, when railway vehicles of many different types are employed, the sliding door cannot be opened in conformity with entrances which vary widely in position and dimension. This is impossible particularly where it is necessary to change the sliding directions of the sliding doors.

Partitions provided with doors which are formed on the side of a platform facing a track must necessarily be spaced a considerable distance apart, to minimize shaking caused by trains passing or advancing into the platform at high speeds. If there is a considerable distance between a railway vehicle and a door in this manner, however, a problem arises in that passengers getting on and off of the train are forced into the space between the railway vehicle and the partition door. This problem is particularly pronounced when the platform or railway vehicle is crowded, such as during rush-hour commuting times. To solve the problem, it is desirable to provide protective equipment between the railway vehicle and the partition door, but this is very complicated.

SUMMARY OF THE INVENTION

It is an object of the present invention to provide a door opening and closing apparatus for a railway platform and the like wherein the position and width at which doors are opened can be adjusted and the directions and the strokes in which the doors are opened and closed are variable.

Further, it is another object of the present invention to provide a folding door apparatus having a protective function wherein the distance between a door apparatus portion of a platform and a railway vehicle is reduced and passengers are not driven to positions between the railway vehicle and the folding door apparatus.

In order to attain the object, according to one aspect of the present invention, a door opening and closing driving apparatus for a platform and the like includes a driven roller provided on each of a plurality of sliding doors. Driving rollers for engaging with the driven rollers of the doors are provided, the driving rollers being set to a distance smaller than the length of the driven rollers. The driving rollers of the doors perform opening operations necessary to open and close the doors in conformity with the positions and dimensions of the entrances of a railway vehicle stopped at the platform.

According to another aspect of the present invention, a door opening and closing apparatus for a railway platform is characterized in that each of a plurality of sliding doors has a door end which can make an opening end. Opening and closing acting bodies are each provided with an engaging element engageable with the door end. Each of the opening and closing acting bodies is provided with a driven roller, and driving rollers for engaging with the driven rollers are provided. The driving rollers are set to a distance smaller than the length of the driven rollers, and the driving rollers of the doors perform opening operations necessary to open and close the doors in conformity with the positions and dimensions of the entrances of a railway vehicle stopped at the platform.

In the construction as mentioned above, the driving rollers which rotate with intersecting angles in order to move the driven rollers in predetermined directions are contacted with the driven rollers provided directly on the sliding doors or, in the case of folding doors, with the driven rollers held in engagement with the folding doors. Consequently, each of the driven rollers and folding doors are moved relatively by a distance equal to the rolling distance of the driving roller multiplied by the sine of the intersecting angle.

The opening and closing driving sections provided with the driving rollers are disposed at a distance shorter than the length of the driven rollers. The sliding doors or the folding doors can be opened and closed to and from an opening of any variable size directly by way of the driven rollers or by way of the opening and closing acting bodies without being limited by the width of the doors. By adjusting the intersecting angle of the driving rollers, the strokes of the doors can be adjusted, and the opening and closing directions of the doors can be reversed by changing the intersecting angle from a positive value to a negative value.

According to still another aspect of the present invention, a folding door apparatus for a platform for railway vehicles is provided in which folding doors are employed. Two folding doors make one set and a plurality of such sets are provided continuously along the platform. A mid-portion between the two folding doors of each set serves as an inflection point. The plurality of sets of continuous folding doors are provided with a construction which changes over between closed fixed positions in which they are disposed in a serial row along a railway platform and an inflected position which forms opening at position corresponding to the entrances of a railway vehicle stopped at the platform. A logic unit is provided having a construction wherein directions of movement and stroke amounts of the doors are set and controlled in response to information regarding the positions and widths of the entrances of the railway vehicle stopped at the platform. A pair of opening and closing acting bodies are provided for each set of the folding doors. A door opening and closing driving apparatus which can provide a necessary direction of movement and stroke amount is also provided.

According to a further aspect of the present invention, the folding door apparatus for a railway platform of the construction described above is characterized in that the inflecting direction of the folding doors when they are opened is a direction in which they approach the railway vehicle side. The arrangement of the folding doors upon closing is set such that the inflection points of the folding doors in a most inflected condition form approached positions at which the inflectiong points do not contact the railway vehicle. The inflecting direction of the folding doors when they are opened is a direction in which they move away from the railway vehicle side. The positions of the folding doors upon closing are set to approached positions at which the folding doors do not contact the railway vehicle.

In the construction as mentioned above, from the position of the doors wherein the plurality of sets of folding doors each consisting of two folding doors are disposed in a serial row, the door opening and closing driving apparatus selects a pair of the folding doors to be opened in response to information regarding an entrance of a railway vehicle. The selected folding doors drive the pair of opening and closing acting bodies to a position corresponding to the position and the dimension of the entrance, and the selected folding doors and/or adjacent folding doors can be successively inflected to form a predetermined opening.

In this distance, in order to move the folding doors in conformity with the entrance of the railway vehicle, the door opening and closing apparatus of the present invention includes a logic unit which can process information regarding the positions and widths of the entrances of the railway vehicle to calculate directions of movement and stroke amounts of the folding doors. The logic unit also controls a varying mechanism of the driving apparatus in response to the calculation signal and sets an opening position and an opening width of the folding doors in conformity with the entrance of the railway vehicle.

DETAILED DESCRIPTION OF THE PREFERRED EMBODIMENTS

In the following, embodiments of the present invention are described with reference to the drawings.

Figure 1:
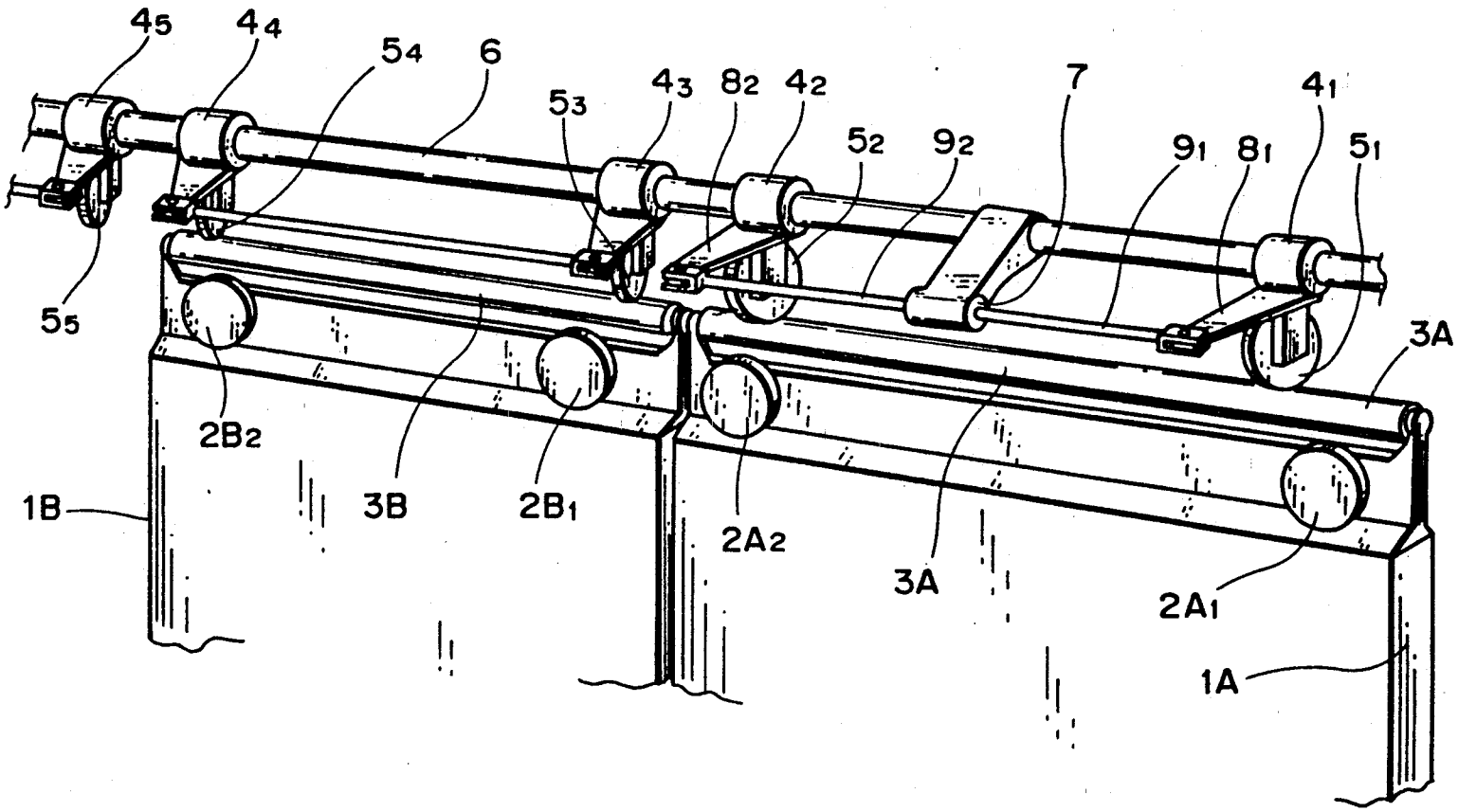
FIG. 1 shows in perspective view an embodiment of an opening and closing apparatus of the present invention.

FIG. 1 shows a first embodiment of a door opening and closing apparatus of the present invention. In the first embodiment, a sliding door is employed. Sliding doors 1A and 1B are, in the condition shown, in a closed condition. From this condition, the sliding doors 1A and 1B can be opened in conformity with entrances of a railway vehicle by operation of the door opening and closing apparatus. Door rollers $2A_1$, $2A_2$ and $2B_1$ and $2B_2$ are mounted on brackets formed at upper positions of the sliding doors 1A and 1B. Since the door rollers are placed on a sliding door supporting rail (not shown), the sliding doors 1A and 1B are moved when leftward or rightward force is applied to the sliding doors 1A and 1B.

Driven rollers 3A and 3B are mounted at upper end sides of the brackets provided on the sliding doors 1A and 1B. The individual driven rollers 3A and 3B are held in engagement with driving rollers $5_1$, $5_2$, $5_3$, $5_4$, and $5_5$ provided on door opening and closing driving sections $4_1$, $4_2$, $4_3$, $4_4$, and $4_5$, respectively. Each of the door opening and closing driving sections $4_1$, to $4_5$ is supported on a support shaft 6. The support shaft 6 supports an actuator 7 thereon. The individual actuators are provided to set intersecting angles of the driving rollers $5_1$ and $5_2$ of the door opening and closing driving sections $4_1$ to $4_2$ with respect to the driven roller 3A of the sliding door 1A and to set intersecting angles of the driving rollers $5_3$ to $5_5$ of the door opening and closing driving sections $4_3$ to $4_5$ with respect to the driven roller 3B of the sliding door 1B. An action of each of the actuators 7 can modify the intersecting angle of the driving roller by way of rods $9_1$ and $9_2$ connected between arm portions $8_1$ and $8_2$ formed on the door opening and closing driving sections $4_1$ and $4_2$, respectively. It is to be noted that the actuators for the left side door opening and closing driving sections $4_3$ to $4_5$, that is, the actuators for the sliding door 1B, are not shown.

When the driving rollers $5_1$ to $5_4$ of the door opening and closing driving sections $4_1$ to $4_4$ rotate, the driving rollers $5_1$ and $5_2$ to which a predetermined intersecting angle is provided by the actuator 7 move the driven roller 3A in the rightward direction, and the sliding door 1A is moved in the rightward direction together with the driven roller 3A. Since the intersecting angle of the driving rollers $5_3$ and $5_4$ is set opposite to the intersecting angle of the driving rollers $5_1$ and $5_2$, the sliding roller 1B is moved in the leftward direction, and the sliding doors 1A and 1B are moved to the opposite sides and opened. The door opening and closing driving section $4_5$ is controlled to the same intersecting angle as the door opening and closing driving section $4_4$ and is engaged with the sliding door 1B fed in the leftward direction so that it provides a greater leftward stroke amount to the sliding door 1B.

The door opening and closing driving sections are disposed continuously such that the pitch between the two door opening and closing driving sections $4_1$ and $4_2$ or $4_3$ and $4_4$ is set smaller than the length of each driven roller. Consequently, feeding of a continuous long stroke amount can be permitted. In the case wherein the power of the door opening and closing driving sections is concentrated, the support shaft 6 described above can be constructed as a driving shaft, and power can be transmitted to the driving roller by way of gears or the like.

Figure 2:
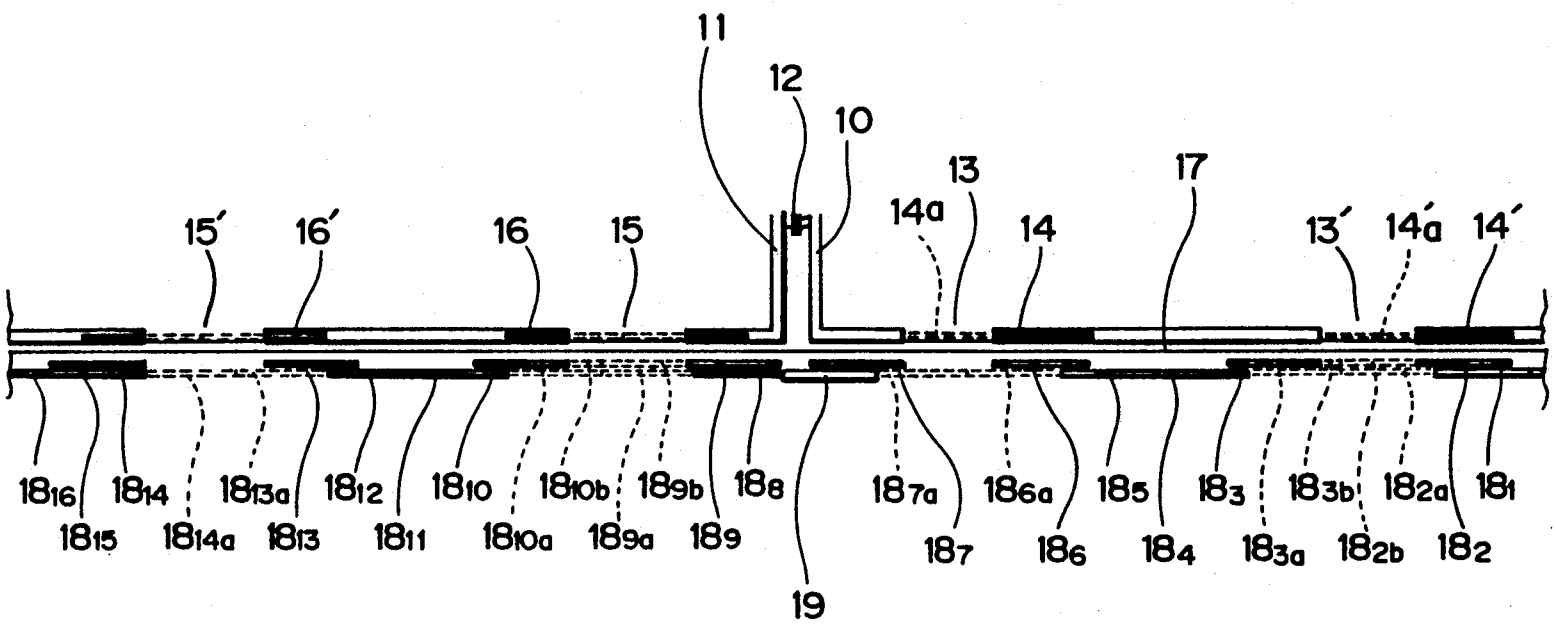
FIG. 2 shows a plan view of a sliding door apparatus for a platform when the opening and closing apparatus of FIG. 1 is applied to a railway platform.
Figure 3:
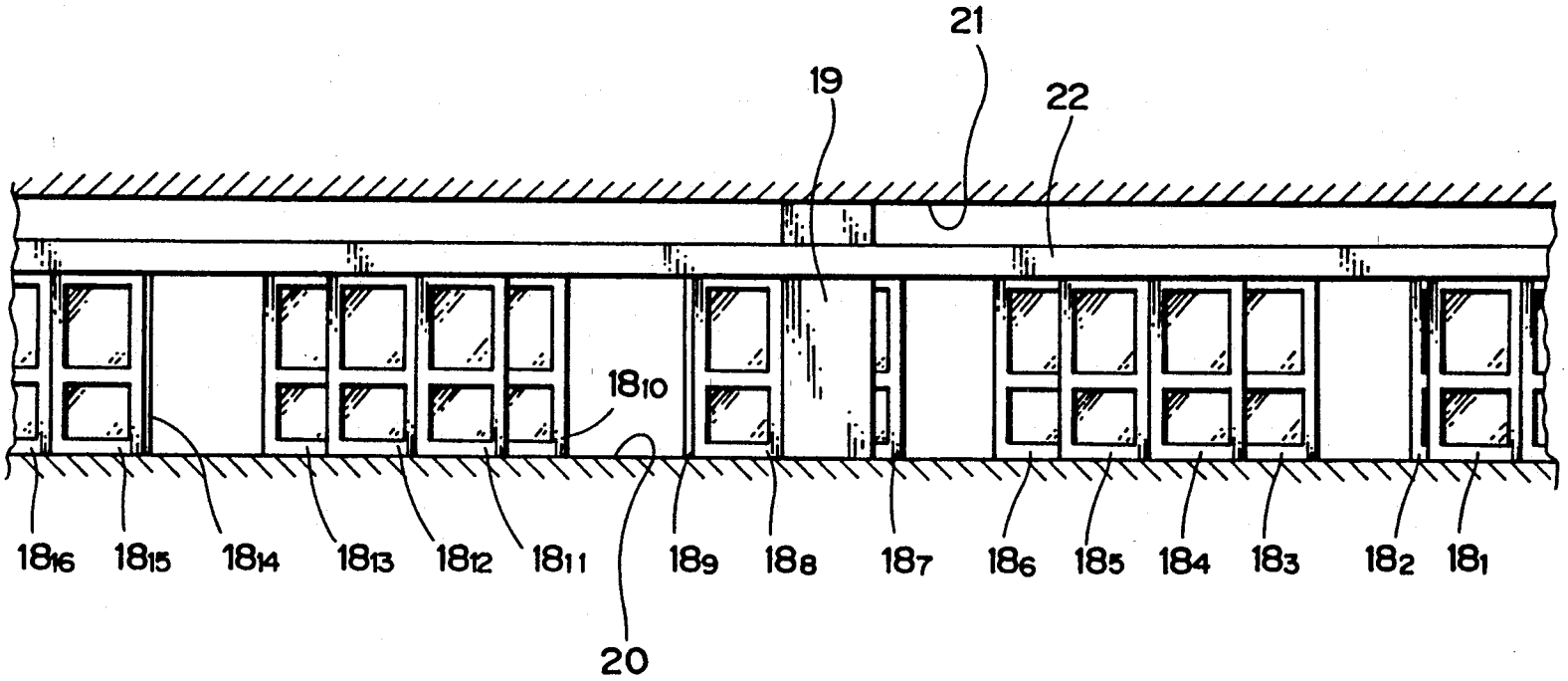
FIG. 3 is a side elevational view of the sliding door apparatus shown in FIG. 2.

A relationship between entrances of vehicles and sliding doors when the door opening and closing apparatus of the present invention shown in FIG. 1 is applied to sliding doors at a railway platform is illustrated in FIGS. 2 and 3.

FIG. 2 illustrates in plan view a relationship between a railway vehicle and a sliding door apparatus provided with the door opening and closing apparatus of the present invention. FIG. 3 is a side elevational view of sliding doors as part of a sliding door apparatus. Referring to FIG. 2, reference numerals 10 and 11 denote each a vehicle. The vehicles 10 and 11 are coupled to each other by means of a coupler 12 to constitute a train. A pair of entrances 13 and 13' are formed on the vehicle 10. A pair of sliding doors 14 and 14' of the single sliding type are disposed at the entrances 13 and 13' such that they open and close the entrances 13 and 13'. At solid line positions shown in FIG. 2, the sliding doors 14 and 14' are in a condition in which they open the entrances 13 and 13'. The sliding doors **14*a* and 14*a'* indicated by broken lines show a condition wherein they close the entrances 13 and 13'. Entrances 15 and 15' of the vehicle 11 are of a different width than those of the vehicle 10 and accordingly are provided with sliding doors 16 and 16'** of the double sliding type.

Reference numeral 17 denotes a platform edge of a platform. Sliding doors $18_1$ to $18_7$ and $18_8$ to $18_{16}$ are disposed continuously in a serial row along the platform edge 17. In the drawings, the sliding doors in a closed condition are provided with the suffix a like $18_{2a}$, $18_{3a}$, $18_{6a}$, . . . and are indicated by broken lines. The sliding doors in the condition make a straight line and the position of each of the sliding doors is referred to as a stationary fixed position. When the sliding doors are to be opened, the sliding doors are shifted from the broken line positions to alternate long and short dash line positions provided with the suffix b (positions moved in parallel toward the platform edge 17 side, shown only as $18_{2b}$, $18_{3b}$, $18_{6b}$, $18_{9b}$, and $18_{10b}$, hereinafter referred to as shifted positions. Next, they are shifted to solid line positions without a suffix in predetermined directions by predetermined stoke amounts so that openings registered with the entrances 13, 13', 15 and 15' of the vehicles may be formed.

A fixed wall 19 is disposed in a common plane with the sliding doors between the sliding doors $18_7$ and $18_8$. The fixed wall 19 is at a location which corresponds to a connecting portion of a train and has no relation to an entrance when any of the various trains are stopped. The positional relationship between the platform and the train in FIG. 2 is such that the center of the fixed wall 19 and the center of the connecting portion of the vehicles do not coincide with each other. A condition is shown wherein the train is stopped at a position displaced leftward from the platform. Even in case the stopping position of the train is displaced from a regular stopping position of the platform in this manner, openings of the doors at the positions coinciding with the entrances of the vehicles are formed by the opening and closing driving apparatus for the sliding doors.

While, in the embodiment of the present invention described so far, openings of the doors equal to the size of the entrances described above are formed by movement of the sliding doors at the positions of the entrances of the vehicles, it is also possible to open the doors by amounts greater than the magnitudes of the entrances by controlling the movement of the sliding doors.

FIG. 3 is a side elevational view of the view shown in FIG. 2 and shows a condition wherein the sliding doors are open. Reference numeral 20 denotes a floor of the platform, 21 a ceiling and 22 a door header. Supporting apparatus for the sliding doors and opening and closing driving apparatus are accommodated in the inside of the door header 22.

Figure 4:
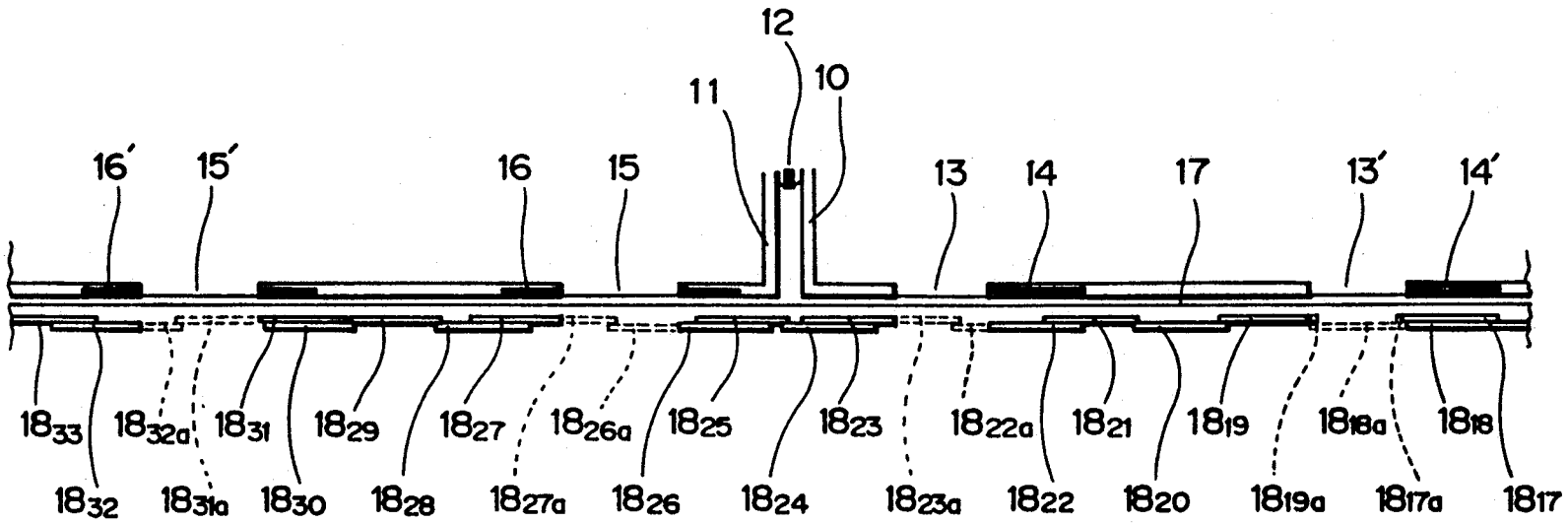
FIG. 4 is a plan view showing another embodiment of a sliding door apparatus different from the sliding door apparatus of FIGS. 2 and 3.
Figure 5:
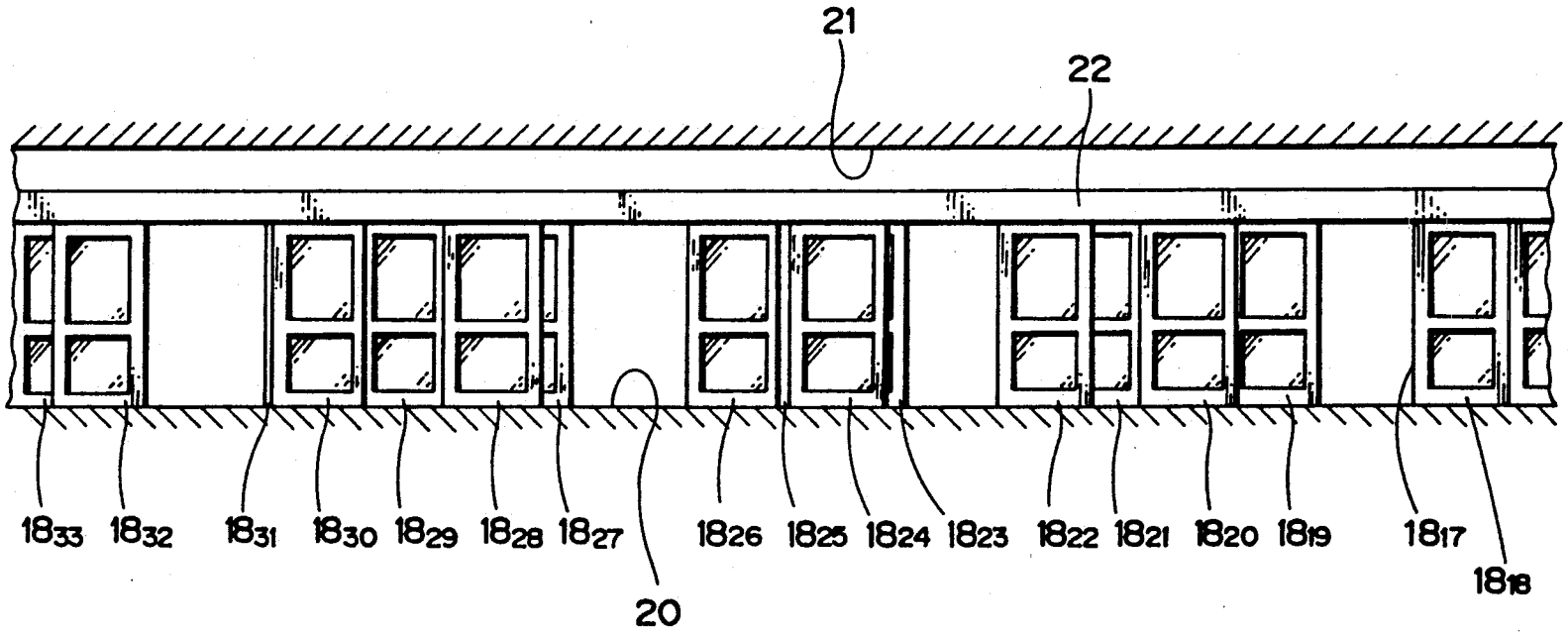
FIG. 5 is a side elevational view of the sliding door apparatus of FIG. 4.

FIGS. 4 and 5 show an arrangement of a sliding door apparatus in which a door opening and closing driving apparatus as another embodiment shown in FIG. 6 which will be hereinafter described is employed. In the present embodiment, sliding doors are disposed at fixed positions in two rows parallel to a platform edge. The odd-numbered sliding doors are disposed in one of the rows and the even-numbered sliding doors are disposed in the other row such that they are disposed alternately to present a closed condition. The sliding doors at a position conforming with an entrance are moved in predetermined directions by predetermined stroke amounts by the door opening and closing driving apparatus.

FIG. 4 corresponds to FIG. 2 while FIG. 5 corresponds to FIG. 3, and like reference characters are applied to like portions. Referring to FIG. 4, reference numerals 10 and 11 denote each a vehicle. Vehicles 10 and 11 are coupled to each other by means of a coupler 12 to constitute a train. A pair of entrances 13 and 13' are formed in the vehicle 10, and a pair of sliding doors 14 and 14' of the single sliding type are disposed at the entrances 13 and 13' such that they may open and close the entrance doors 13 and 13'. At solid line positions shown in FIG. 4, the sliding doors 14 and 14' are in a condition in which they open the entrance doors 13 and 13'. Entrances 15 and 15' of the railway vehicle 11 are of a different width than those of the railway vehicle 10 and accordingly are provided with sliding doors 16 and 16' of the double sliding type.

Reference numeral 17 denotes a platform edge of a platform. Sliding doors $18_{17}$ to $18_{24}$ and $18_{25}$ to $18_{33}$ are disposed continuously in two rows along the platform edge 17. Of the sliding doors, those sliding doors $18_{17}$, $18_{19}$, $18_{21}$ and so forth which have odd-numbered suffixes are supported on a sliding door supporting rail adjacent the platform edge 17 while the even-numbered sliding doors $18_{18}$, $18_{20}$, $18_{22}$ and so forth are supported on another sliding door support rail remote from the platform edge 17. The sliding doors arranged alternately at fixed positions in two rows in this manner are positioned in a closed condition except when a railway vehicle stops at the platform. In the drawings, each sliding door which contributes to an opening action is indicated by a broken line when it is at its closed position and such sliding doors are indicated by $18_{17a}$, $18_{18a}$, $18_{19a}$.

For the entrance 13, the sliding door $18_{22a}$ is moved rightward to the sliding door $18_{22}$ while the sliding door $18_{23a}$ is moved leftward to the sliding door $18_{23}$. Meanwhile, for the other entrance 13', the sliding door $18_{17a}$ is moved rightward a little to the sliding door $18_{17}$ and the sliding door $18_{18a}$ is moved rightward by a great distance to the sliding door $18_{18}$ while the sliding door $18_{19a}$ is moved leftward a little to the sliding door $18_{19}$, thereby opening the sliding doors at the closed fixed positions in conformity with the entrances of the railway vehicle. Also for the entrances 14 and 14', the sliding doors corresponding to them can be opened similarly in conformity with the entrances of the railway vehicle.

FIG. 5 shows side faces of the sliding doors of FIG. 4, and the sliding doors are in an open condition. Reference numeral 20 denotes a floor of the platform, 21 a ceiling, and 22 a door header. Supporting sections for sliding doors and door opening and closing driving apparatus are accommodated in the inside of the door header 22.

Figure 6:
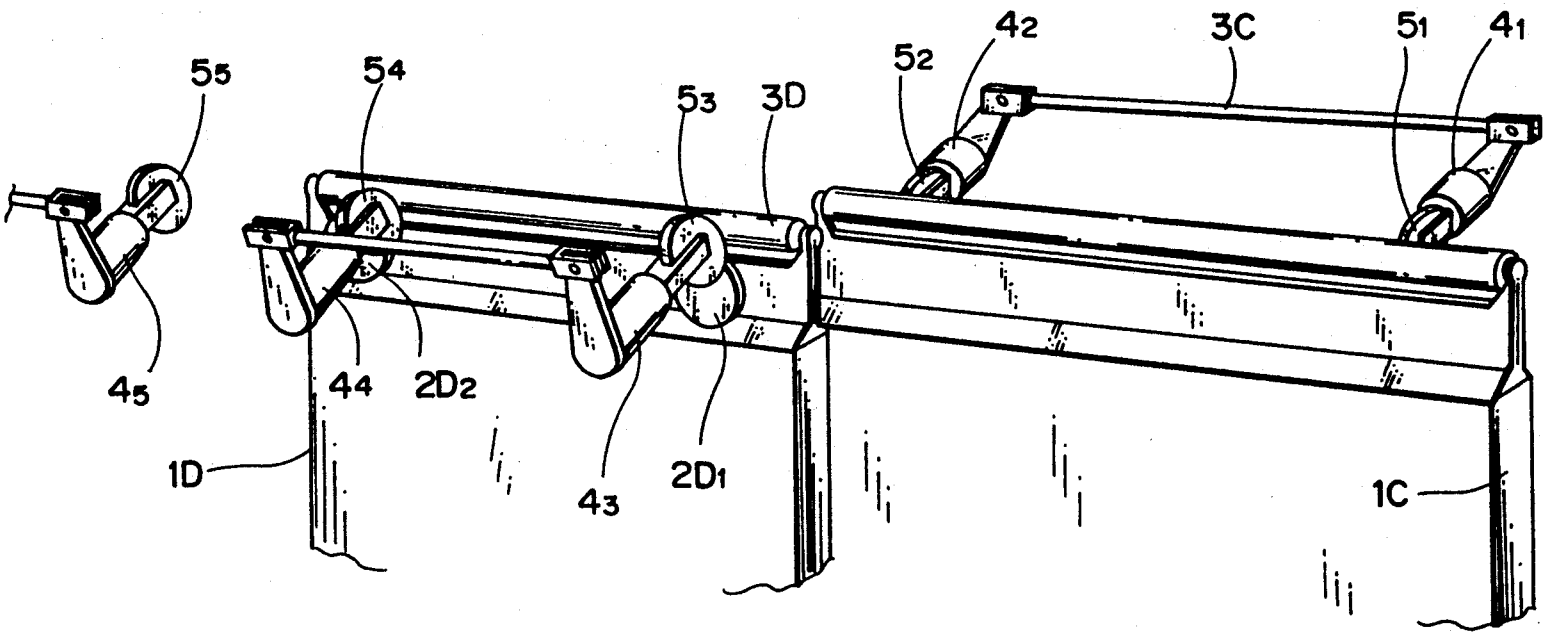
FIG. 6 shows in perspective view another opening and closing apparatus of the present invention which can be applied to the sliding door apparatus shown in FIGS. 4 and 5.

In FIG. 6, an embodiment of a door opening and closing apparatus is illustrated wherein adjacent sliding doors are disposed alternately at closed fixed positions in two rows. In FIG. 4, two adjacent sliding doors 1C and 1D to be opened are arranged in two rows at the closed fixed positions. Similarly as in the case of FIG. 1, a pair of door rollers $2D_1$ and $2D_2$ (door rollers of the sliding door 1C are not shown) are mounted on a bracket provided at an upper position of each of the sliding doors 1C and 1D. Each of the door rollers $2D_1$ and $2D_2$ is placed on a sliding door supporting rail (not shown) such that the sliding doors 1C and 1D can be opened when a rightward or leftward force is applied to the sliding doors 1C and 1D by an action of the door opening and closing driving apparatus.

In the condition shown, a driven roller 3C is disposed at an end of the bracket provided at the upper portion of the sliding door 1C. A pair of driving rollers $5_1$ and $5_2$ of door opening and closing driving sections $4_1$ and $4_2$ are engaged with a driven roller 3C so that, when the driving rollers $5_1$ and $5_2$ rotate, the sliding door 1C is moved to the right side of the axial direction of the driven roller $3_1$ due to intersecting angles set to the driving rollers $5_1$ and $5_2$. Simultaneously, a driven roller $3_2$ of the sliding door 1D and driving rollers $5_3$ and $5_4$ of door opening and closing driving sections $4_3$ and $4_4$ are engaged with each other so that, when the driving rollers $5_3$ and $5_4$ rotate, the sliding door 1D is moved to the left side of the axial direction of the driven roller $3_2$ due to intersecting angles set to the driving rollers $5_3$ and $5_4$. When the sliding door 1D is moved in the leftward direction, the sliding door 1D is disengaged from the door opening and closing driving section $4_3$ but is engaged with another door opening and closing driving section $4_5$ so that it is provided with a greater leftward stroke amount.

The movement of the sliding doors 1C and 1D is such that the door opening and closing driving sections $4_1$ to $4_5$ are controlled in response to positions and magnitudes of railway vehicle entrances to form predetermined openings. The door opening and closing driving sections are disposed continuously while the pitch between the two door opening and closing driving sections $4_1$ and $4_2$ or $4_3$ and $4_4$ is made smaller than the length of each driven consequently, feeding of a continuous long stroke amount can be permitted.

Figure 7:
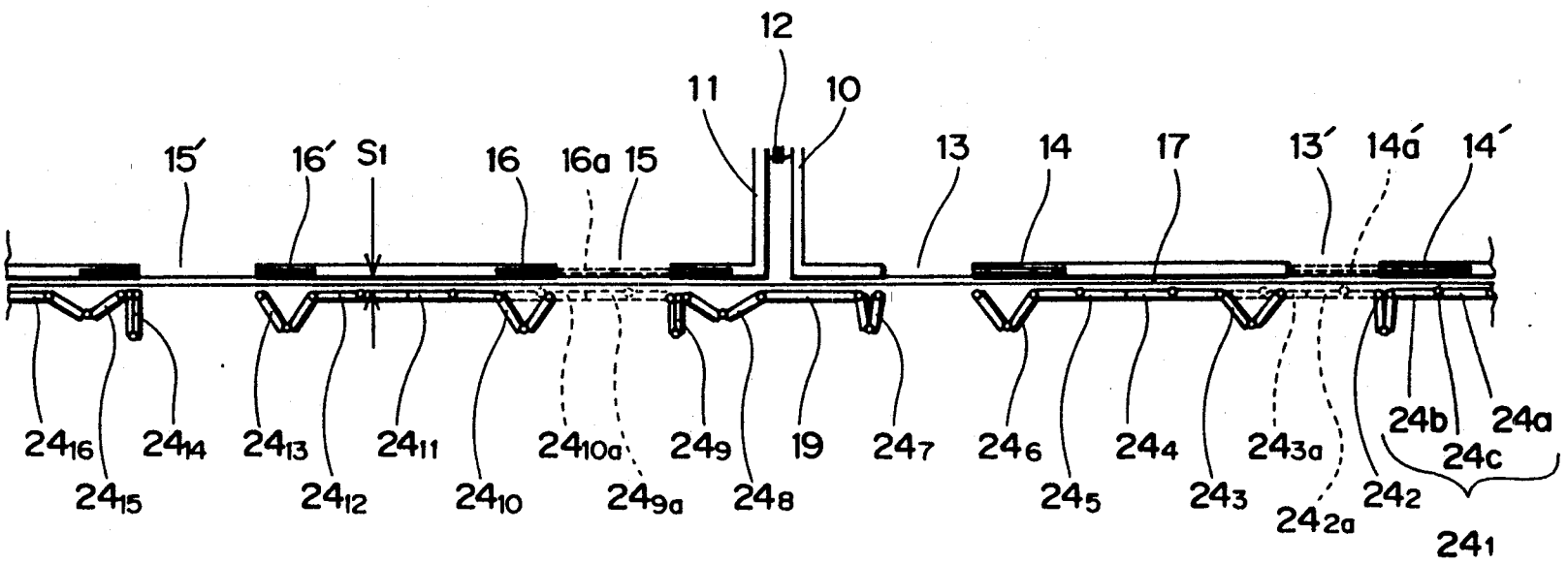
FIG. 7 is a plan view showing an embodiment wherein an opening and closing apparatus of the present invention is applied to a folding door apparatus.
Figure 8:
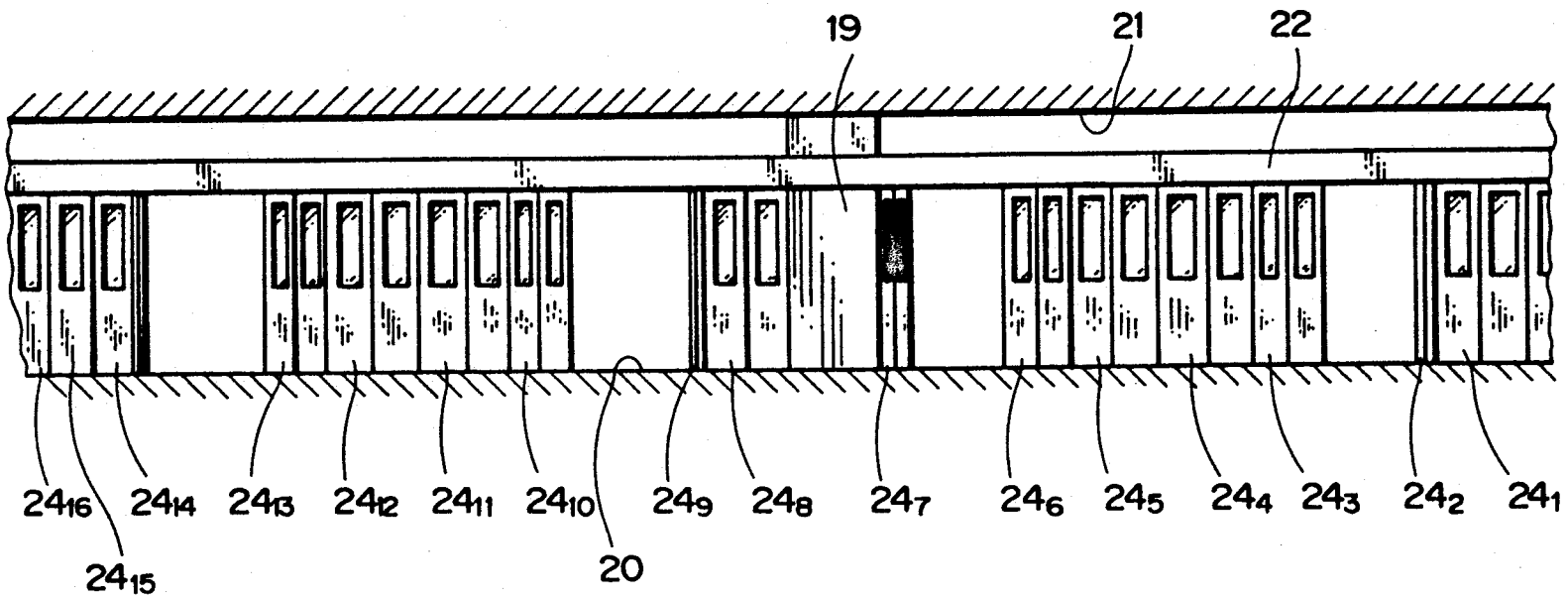
FIG. 8 is a side elevational view of the folding door apparatus shown in FIG. 7.

FIGS. 7 and 8 illustrate in plan view and side elevational view a relationship to railway vehicles when folding doors are employed in the door opening and closing apparatus of the present invention. Referring to FIG. 7, reference numerals 10 and 11 denote each a vehicle, and the vehicles 10 and 11 are coupled to each other by means of a coupler 12 to constitute a train. A pair of entrances 13 and 13' are formed on the vehicle 10, and a pair of sliding doors 14 and 14' of the single sliding type are disposed at the entrances 13 and 13' such that they may open and close the entrance doors 13 and 13'. At solid line positions shown in FIG. 7, the sliding doors 14 and 14' are in a condition in which they open the entrance doors 13 and 13' and the sliding door 14' indicated by a broken line shows a condition wherein it closes the entrance 13'. Entrances 15 and 15' of the vehicle 11 are of a different width than those of the railway vehicle 10 and accordingly are provided with sliding doors 16 and 16' of the double sliding type.

Reference numeral 17 denotes a platform edge of a platform folding doors $24_1$ to $24_7$ and $24_8$ to $24_{16}$ are disposed continuously in serial row along the platform edge 17. In the drawing, the folding doors in a closed condition are provided with the suffix a like $24_{2a}$, $24_{3a}$, $24_{9a}$, and $24_{10a}$ and are indicated by broken lines. The folding doors in such closed condition make a straight line and the positions of the folding doors will be hereinafter referred to as stationary fixed positions. Upon opening of the folding doors, in order to form openings registered with the entrances 13, 13', 15 and 15' of the railway vehicles, the folding doors to be moved in order to form the openings are driven in predetermined directions by predetermined stroke amounts to the solid line positions having no suffix while inflecting the folding doors on the opening end sides and successively inflecting adjacent folding doors.

Each of the folding doors indicated by the folding doors $24_1$ to $24_7$ and $24_8$ to $24_{16}$ is constructed such that it is composed of a set of elements 24*a* and 24*b*. A joining point between the set of elements 24*a* and 24*b* is made an inflecting point 24*c* as shown in the folding door $24_1$ as an example. The folding doors $24_6$ and $24_7$ are positioned corresponding to the entrance 13 of the vehicle 10 and similarly the folding doors $24_2$ and $24_3$ are positioned corresponding to the entrance 13'. As the individual folding doors are inflected at the inflecting points 24*c*, they are moved leftward and rightward so as to conform with the openings of the entrances. Meanwhile, the folding doors $24_9$ and $24_8$ which can be moved in the rightward direction and the folding door $24_{10}$ which can be moved in the leftward direction are positioned corresponding to the entrance 15 of the vehicle 11. Similarly, the folding door $24_{13}$ which can be moved in the rightward direction and the folding doors $24_{14}$ and $24_{15}$ which can be moved in the leftward direction are positioned corresponding to the entrance 15'.

Of the two folding doors $24_9$ and $24_8$ which are moved in the rightward direction with respect to the entrance 15, the folding door $24_9$ on the opening end side is first inflected around the inflecting point 24*c* until inner faces of the set of elements 24*a* and 24*b* are contacted with each other. Further, movement of the folding door $24_9$ in the rightward direction inflects the adjacent folding door $24_8$ around the inflecting point $24_c$ in accordance with the amount of movement. Similarly, operation of the two folding doors $24_{14}$ and $24_{15}$ which are moved in the leftward direction with respect to the entrance 15' is similar. In this manner, the openings conforming to opening dimensions of railway vehicle entrances can be set by the folding doors.

The distance indicated by $S_1$ is a dimension between side faces of the vehicles 10 and 11 and the folding doors 24 provided at the platform and is a critical dimension to which the folding doors 24 are approached without contacting with the side faces of the vehicles 10 and 11 which are running. In the present invention, the position of each of the folding doors 24 is set to such critical distance $S_1$.

A fixed wall 19 is disposed in a common plane with the folding doors between the folding doors $24_7$ and $24_8$. The fixed wall 19 is at a location which corresponds to a connecting portion of a train and normally is free from an entrance. Consequently, there is no necessity of providing a folding door there.

The positional relationship between the platform and the train in FIG. 7 is such that the center of the fixed wall 19 and the center of the connecting portion of the vehicles do not coincide with each other. A condition is shown wherein the train is stopped at a position displaced leftward from the platform. Even in case the stopping position of the train is displaced from a regular stopping position of the platform in this manner, openings coinciding with the entrances of the vehicles can be formed by the inflecting movement of the folding doors.

While, in the embodiment of the present invention described so far, openings equal to the sizes of the entrances described above are formed by inflecting movement of the folding doors at the positions of the entrances of the vehicles, it is also possible to provide openings wider than the entrances by controlling movement of the folding doors.

FIG. 8 is a side elevational view of the view shown in FIG. 7 and shows a condition wherein the folding doors are open. Reference numeral 20 denotes a floor of the platform, 21 a ceiling, and 22 a door header. Supporting sections and opening and closing driving mechanisms for the folding doors are accommodated in the inside of the door header 13.

While a predetermined opening is obtained in the embodiment of the present invention described above by inflecting, when an opening is to be formed, the inflecting point 24*c* of a folding door moves away from the side face of the vehicle so as to form a concave shape in the arrangement of FIG. 7. In a second embodiment of the present invention shown in FIG. 9, when folding doors are to form an opening, inflecting points 24*c* of folding doors 24 are inflected in a direction in which they approach the side faces of the railway vehicles, that is, in a direction in which they make a convex shape.

Figure 9:
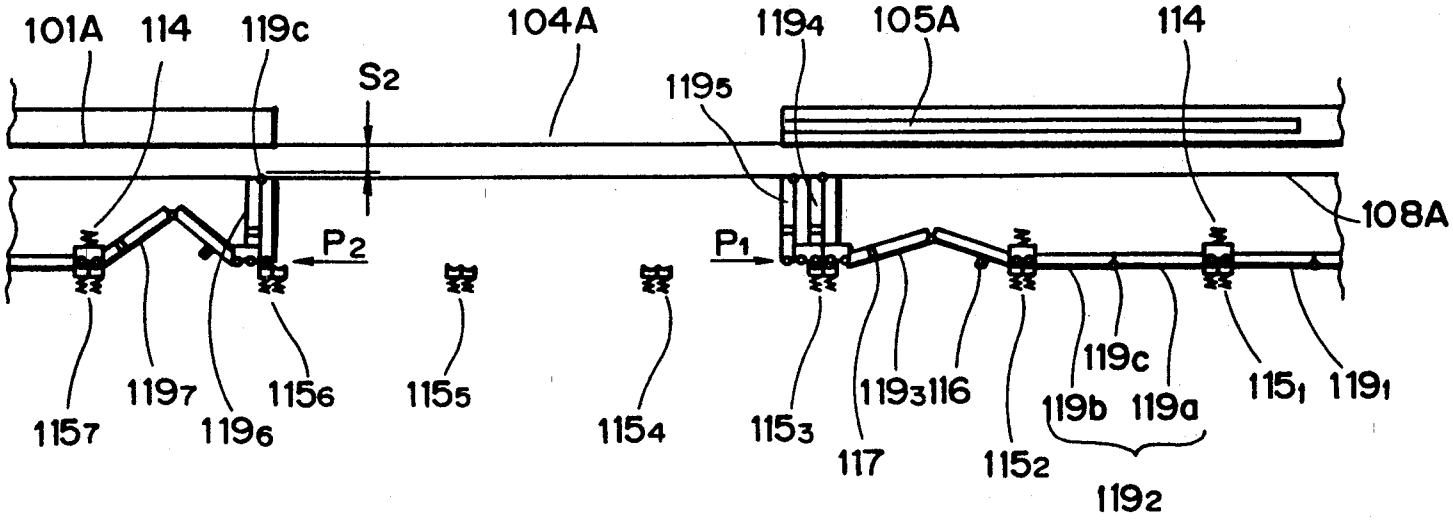
FIG. 9 is a plan view showing another embodiment of a folding door apparatus of the present invention.

Referring to FIG. 9, a vehicle 101A is in a condition wherein a sliding door 105A of the single sliding type is opened to open an entrance 104A . A plurality of folding doors 119, to $119_7$ are provided in a spaced relationship at a fixed distance away from a platform edge 108A of a platform in a serial row in a closed condition. In such an open condition as shown in FIG. 9, the sliding doors at the position corresponding to the entrance 104A are inflected. Each of the folding doors includes, as represented by the folding door $119_2$, a set of elements 119*a* and 119*b* and an inflecting point 119*c* which is inflected to the vehicle side between the set of elements 119*a* and 119*b*. As adjacent catcher 114 is provided between adjacent folding doors to connect the adjacent folding doors to each other. Further, a latch 115 is provided at coupling portions of each two adjacent folding doors, and the folding doors hold their fixed positions, which are in a horizontal closed condition, by the latches 115.

Further, in the set of elements 119*a* and 119*b*, projected portion 116 is formed on one element while a hole portion 117 is formed on the other element. When the folding door 119 is inflected to its maximum, the projected portion 116 is engaged with the hole portion 117 so that the maximum inflected condition is maintained until fixed pulling forces in the reverse direction act as at $P_1$ and $P_2$. The folding doors $119_4$, $119_5$ and $119_6$ are in their maximum inflected conditions.

In particular, the serial line of the folding doors $119_1$ to $119_7$ is set such that, in a condition wherein the inflecting points 119*c* of the folding doors 119 are inflected to the maximum to the vehicle side from the array of the serial line which is the fixed positions of the folding doors, a dimension $S_2$ at which the inflecting points 119*c* do not contact with side faces of vehicles may be provided. In this instance, the latches $115_1$ to $115_7$ are provided between adjacent folding doors of the serial line of the folding doors $119_1$ to $119_7$ and hold the folding doors at the fixed positions until fixed external forces act upon the connecting points of the folding doors. In order to allow the folding doors $119_1$ to $119_7$ to move in conformity with the entrance 104A of the vehicle, when fixed external forces indicated at $P_1$ and $P_2$ act upon the end portions of the folding door $119_5$ and the folding door $119_6$, the folding doors on the side on which the external forces act are released from the latches and are moved.

While the folding doors are shown in an open condition in the drawing, if the external force $P_1$ acts in the rightward direction upon the end of portion of the folding door $119_5$, the end portion of the folding door $119_5$ is released from the latch $115_5$ to allow the folding door $119_5$ to be inflected to its maximum. Then movement of the folding door $119_5$ in the rightward direction inflects and moves the folding door $119_4$ positioned rightward thereof so as to be inflected to the maximum thereby to further inflect the folding door $119_3$ a little, in which condition a predetermined opening dimension is obtained. When the external force $P_2$ acts in the leftward direction at the end portion of the folding door $119_6$, the end portion $119_6$ is released from the latch $115_5$ to allow the folding door $119_6$ to be inflected to the maximum and then inflect the folding door $119_7$ to an intermediate degree thereby to obtain a predetermined opening dimension. In the present embodiment, the folding door $119_5$ (also the adjacent folding door $119_4$) and the folding doors $119_6$ positioned at the end portions of the entrance are both in the maximum inflected condition.

A pair of protective walls (not shown) are provided to the left and right of each entrance, and the positional relationship between a side face of the vehicle 101A and the folding doors 119 is such that the dimension $S_2$ of the distance between the side face of the vehicle 101A and the inflecting points 119*c* projected toward the side face of the vehicle 101A when the folding doors 119 are inflected to the maximum. Consequently, passengers are driven in the leftward or rightward directions when they get on or off the train, which is effective in preventing danger.

When the folding doors are moved from the open condition shown to the closed condition, the folding doors $119_3$ and $119_7$ which are spaced away from the opening portion and present small inflections are put into a straight condition. Then the folding doors $119_4$ and $119_6$ adjacent the folding doors are put into a straight condition, whereafter the folding door $119_5$ adjacent the folding door $119_4$ is extended into a straight condition.

Figure 10:
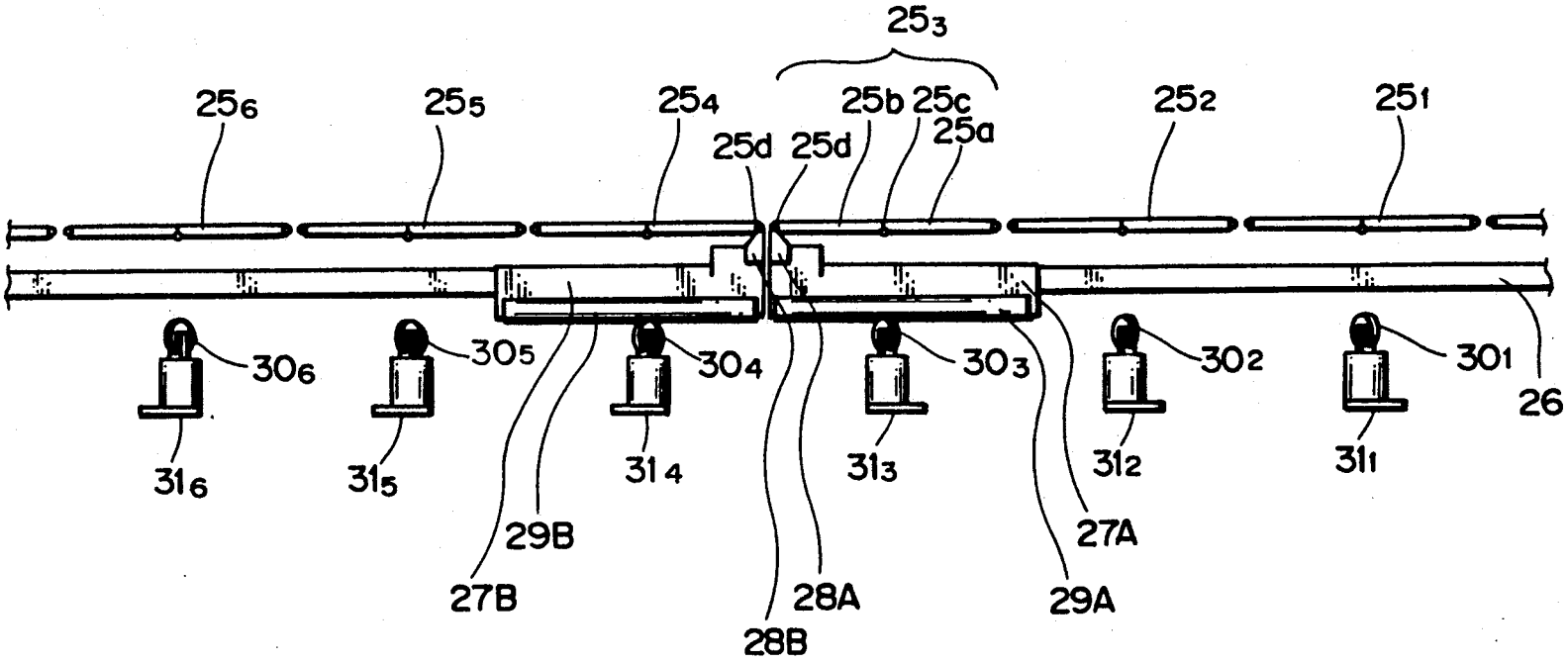
FIG. 10 illustrates in plan view a relationship between a folding door apparatus and an opening and closing apparatus of the present invention and shows a condition wherein the opening and closing apparatus is disposed at a position of folding doors to be opened and closed.
Figure 11:
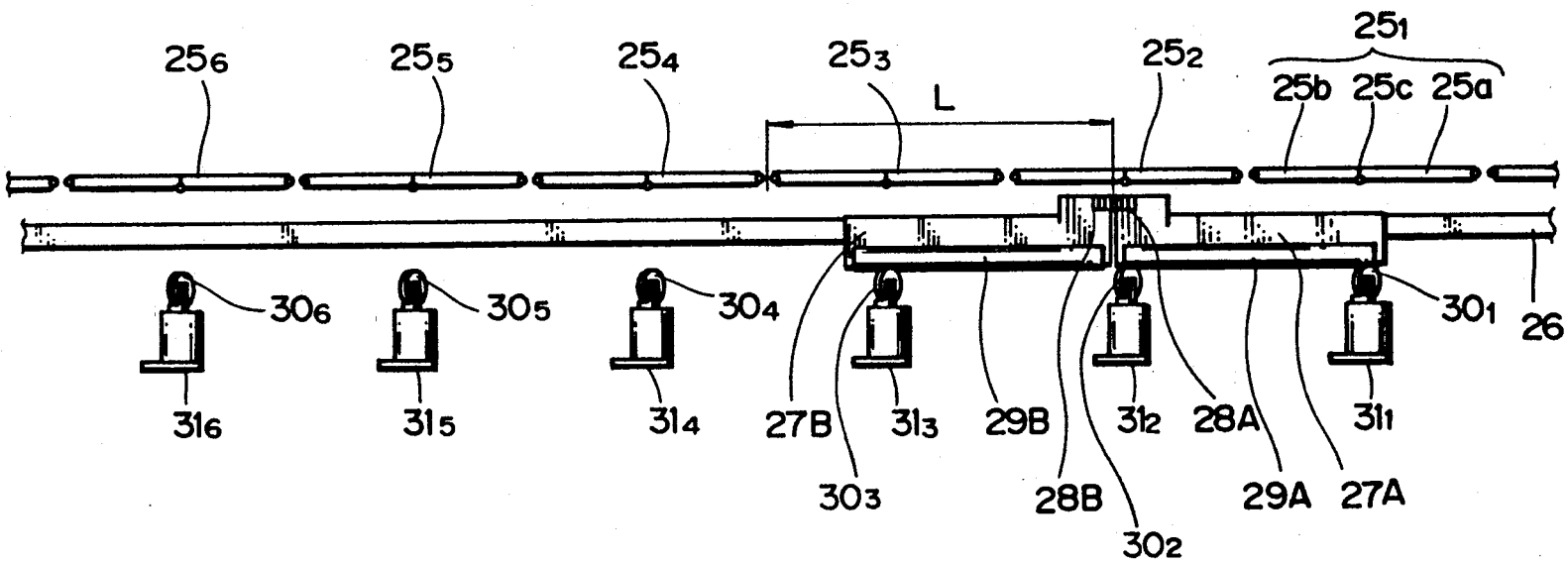
FIG. 11 is a plan view showing a condition before the opening and closing apparatus of the present invention selects a particular folding door of the folding door apparatus.
Figure 12:
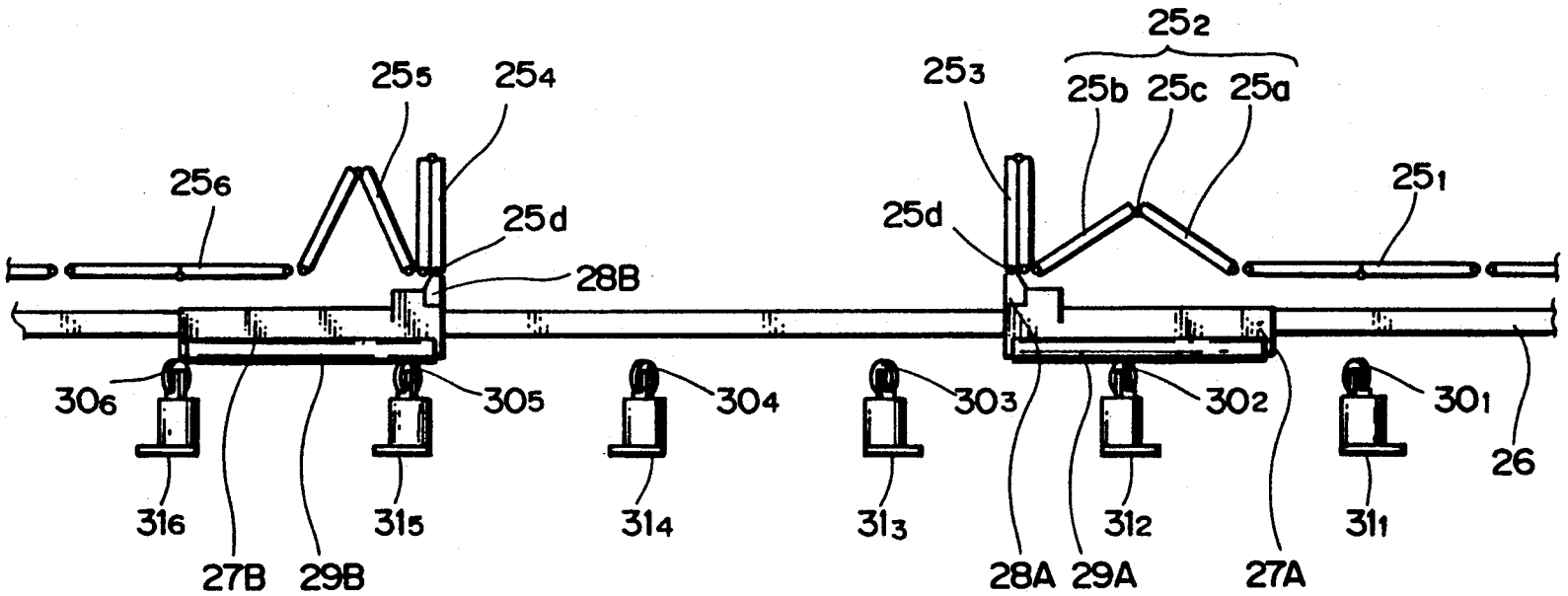
FIG. 12 is a plan view showing a condition wherein the opening and closing apparatus of of FIG. 10 is moved into an open position.

An embodiment of an opening and closing driving apparatus for folding doors of the present invention is shown in FIGS. 10 to 12 (plan views). A condition of the opening and closing driving apparatus for folding doors before starting its operation is shown in FIG. 11 and another condition of the opening and closing driving apparatus immediately before the folding doors are opened is shown in FIG. 10. The relationship between the folding doors forming an opening and the opening and closing driving apparatus is illustrated in FIG. 12.

Folding doors $25_1$ to $25_6$ are positioned in parallel to a platform edge 8A of a platform and hold the position corresponding to an entrance in a closed condition. An opening end of the plurality of folding doors is between the folding doors $25_3$ and $25_4$. As the folding doors $25_3$ and $25_4$ are opened and closed leftward and rightward, the folding doors are opened and closed.

The opening and closing driving apparatus for folding doors is provided with a supporting rail 26 in parallel to the folding doors in the serial arrangement in the closed condition for opening and closing the folding doors. Two opening and closing acting bodies 27A and 27B are disposed for individual movement in leftward and rightward directions on the supporting rail 26. Each of the opening and closing acting bodies 27A and 27B is provided on the folding doors side with engaging elements 25A and 25B for engaging with a door end $25d$ of the folding door $25_3$ at the opening end as well as a door end $25d$ of the folding door $25_4$, respectively, and is provided on the opposite side of the folding doors with driven rollers 29A and 29B adapted to move the opening and closing acting bodies 27A and 27B and mounted in an integrated condition.

For the driven rollers 29A and 29B provided on the opening and closing acting bodies 27A and 27B, opening and closing driving sections $31_1$ to $31_6$ having driving rollers $30_1$ to $30_6$ acting with intersecting angles upon the driven rollers 29A and 29B are disposed. The distance between each adjacent plurality of opening and closing driving sections is set shorter than the length L of the driven rollers 29A and 29B provided on the opening and closing acting bodies 27A and 27B. The opening and closing driving sections $31_1$ to $31_6$ have a construction which can change the intersecting angles of the respective driving rollers $30_1$ to $30_6$.

In the opening and closing apparatus for folding doors of the present invention described so far, the driving rollers $30_3$ and $30_4$ are first rotated by operation of the opening and closing driving section $31_3$ and the opening and closing driving section $31_4$. Consequently, the opening and closing acting body 27A is moved to the right side while the opening and closing acting body 27B is moved to the left. By such movements, the folding doors $25_3$ and $25_4$ are first inflected by way of the engaging elements 28A and 28B so that the folding doors are moved in the opening direction. The intersecting angles of the driving rollers are set in the opposite directions at the opening and closing driving sections $31_1$ to $31_3$ and $31_4$ to $31_6$. With respect to the boundary between the folding door $25_3$ and the folding door $25_4$, the folding door $25_3$ is moved rightward while the folding door $25_4$ is moved leftward. By setting the intersecting angles of the driving rollers opposite to each other, the folding doors thus opened can be moved in the closing direction.

Naturally, the directions of movement of the folding doors can be changed by way of the opening and closing acting bodies by rotating the driving rollers 30 forwardly or in reverse. Consequently, the folding doors can be opened and closed by changing the directions of rotation of the driving rollers without changing the intersecting angles of the driving rollers for the opening stroke and the closing stroke of the folding doors.

Thus, in order to open the folding doors between the folding door $25_3$ and the folding door $25_4$ to a relationship corresponding to an entrance of a railway vehicle, the opening and closing acting bodies 27A and 27B at the position of FIG. 11 are moved to the left by a distance of L. Thereupon, the opening and closing driving sections $31_1$ to $31_4$ are all operated in the leftward feeding condition, and the opening and closing acting bodies 27A and 27B are moved by the distance L. Next, the engaging elements 28A and 28B are engaged with the door ends $25d$ of the folding doors $25_3$ and $25_4$ positioned at the opening ends as shown in FIG. 10 to change the intersecting angles of the driving rollers $30_1$ to $30_3$ of the opening and closing driving sections $25_1$ to $25_3$ into the rightward feeding direction, thereby completing preparations for opening of the folding doors.

The folding doors with which preparations for opening are completed as shown in FIG. 10 are then put into such an open condition as shown in FIG. 12 because the opening and closing acting body 27A starts its movement by the opening and closing driving section $25_3$ in order to form a predetermined opening and the folding doors undergo action of both of the opening and closing driving sections $31_3$ due to the fact that the length of the driven roller 29A is set longer than the distance between two adjacent opening and closing driving sections. Also, the opening and closing acting body 27B undergoes similar action, and an open condition shown is reached.

Figure 13:
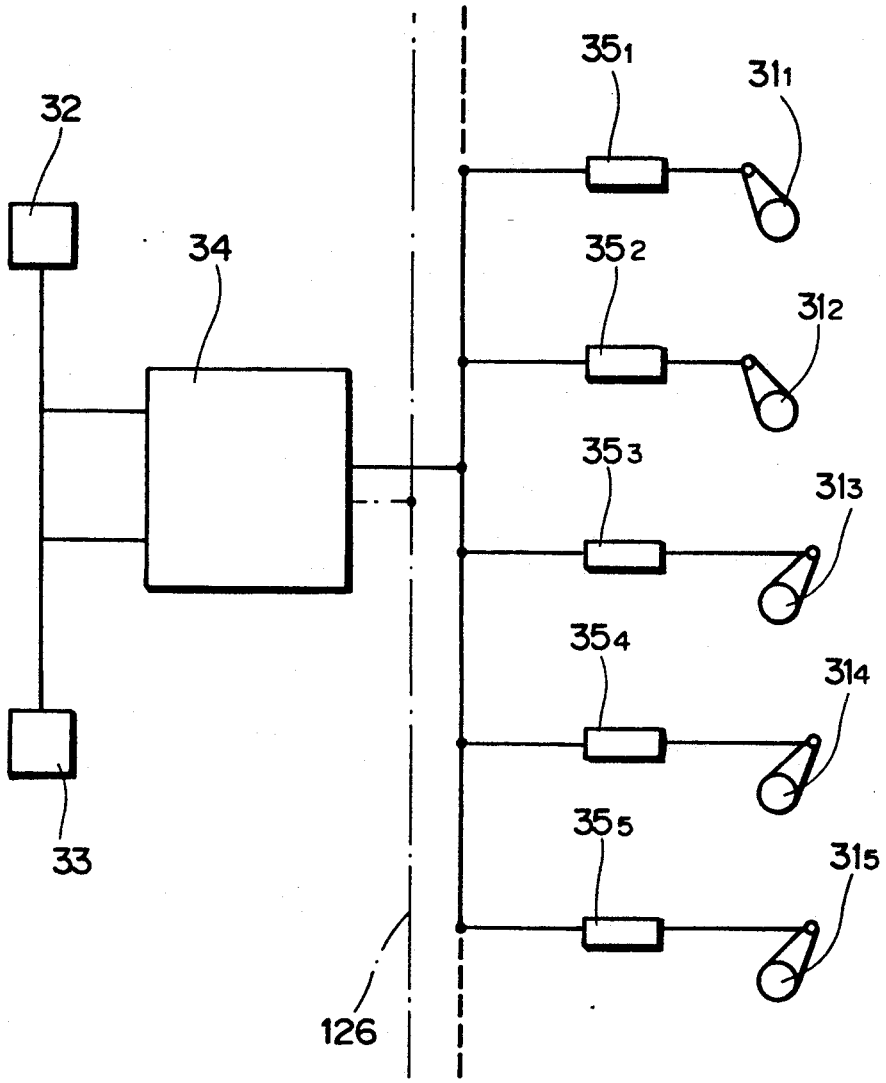
FIG. 13 is a circuit diagram for controlling an opening and closing operating section in the present invention.

A circuit diagram for controlling the opening and closing driving sections in response to information concerning the entrances of a railway vehicle is shown in FIG. 13. From a railway vehicle, information 32 regarding positions and widths of entrances of the vehicle and information 33 regarding a position at which the vehicle stops are obtained, and the two pieces of information 32 and 33 are transmitted to a logic unit 34. The logic unit 34 controls the opening and closing driving sections described above to operate the folding doors to their open positions. In this instance, the logic unit 29 determines if openings corresponding to entrances of the railway vehicle can be set "in which directions" and "by what amounts" and have "the folding doors at which positions" are to be moved, and controls the individual actuators $35_1$ to $35_5$ so that intersecting angles of the opening and closing driving sections $31_1$ to $31_5$ may be obtained in accordance with the determination.

As described so far, the logic unit 34 controls the opening and closing driving sections $31_1$ to $31_5$ so as to move the opening and closing acting bodies 27A and 27B shown in FIGS. 4 to 6 to the predetermined positions, and in addition, plays a role of outputting an instruction to a control line 126 to engage the engaging elements 28A and 28B provided on the opening and closing acting bodies 27A and 27B with the door ends $25d$ of the folding doors $25_3$ and $25_4$. A microcomputer or the like may be used as the logic unit.

Due to the construction of the invention, it has an effect that, even when trains of any different vehicle type stops at the platform and the positions and the widths of its entrances are not fixed, the sliding doors or the folding doors disposed continuously along the platform edge which correspond to the entrances are selected and the thus selected sliding doors or folding doors can be opened in conformity with the entrances by the opening and closing apparatus of the invention. The device of the invention also makes the boarding exit of passengers smooth and safe. Further, the gap formed between a railway vehicle and an opening of the platform door apparatus can be reduced. The danger that passengers will be forced into this gap is thereby reduced, resulting in a superior assurance of safety.

What is claimed is:

1. A folding door apparatus for a railway platform, comprising:

at least two cooperating folding doors each composed of two elements, a mid-portion between the two elements serving as an inflection point of each said folding door, said at least two folding doors being movable between closed positions in which said folding doors are disposed serially along the railway platform and inflected positions in which an opening between said at least two folding doors is formed;

a door opening and closing driving apparatus including a pair of opening and closing acting bodies for moving said folding doors in a direction and amount necessary to form said opening between said folding doors; and a logic unit for analyzing information regarding the position and width of an entrance of a railway vehicle stopped at the platform, and for controlling the direction and amount of movement of said folding doors such that said opening between said folding doors corresponds to the entrance of said railway vehicle.

2. A folding door apparatus for a railway platform as claimed in claim 1, wherein said folding doors are arranged such that during the opening of said folding doors the inflection points of said folding doors approach the railway vehicle and upon opening said folding doors the inflection points of said folding doors are located close to but do not contact with the railway vehicle.

3. A folding door apparatus for a railway platform as claimed in claim 1, wherein said folding doors are arranged such that during the opening of said folding doors the inflection points of said folding doors move away from the railway vehicle and upon closing said folding doors the inflection points of said folding doors are located close to but do not contact with the railway vehicle.

4. A folding door apparatus for a railway platform as claimed in claim 1, including a plurality of folding doors which cooperate to form a plurality of openings between said folding doors corresponding to a plurality of entrances of the railway vehicle.

* * * * *